US005259491A

United States Patent [19]

Ward II

[11] Patent Number: 5,259,491

[45] Date of Patent: Nov. 9, 1993

[54] SMART CART AND BOX SYSTEM FOR PARKING METER

[75] Inventor: Seth Ward II, Russellville, Ark.

[73] Assignee: POM Incorporated, Russellville, Ark.

[21] Appl. No.: 796,012

[22] Filed: Nov. 22, 1991

[51] Int. Cl.[5] ..... G07F 9/06

[52] U.S. Cl. ..... 194/350; 232/16

[58] Field of Search ..... 194/350; 232/7, 12, 232/15, 16; 902/9, 13

[56] References Cited

U.S. PATENT DOCUMENTS 2,815,166 12/1957 Sollenberger ..... 232/16

4,380,316 4/1983 Glinka et al. ..... 232/16

4,471,905 9/1984 Sloma et al. ..... 232/15 X 4,729,509 3/1988 Diekhoff ..... 232/16

5,012,075 4/1991 Hutchison et al. ..... 902/13 X

*Primary Examiner*—F. J. Bartuska

*Attorney, Agent, or Firm*—Hill, Steadman & Simpson

[57] ABSTRACT

A parking meter apparatus and method uses a "smart box" for collecting coins. A "smart cart" collects the coins deposited in the smart box when a proper security card is entered into the smart cart for activating a solenoid interlock. Data auditing capabilities exist to download information from the smart box to the smart cart and ultimately to a central computer.

22 Claims, 3 Drawing Sheets

SMART CART AND BOX SYSTEM FOR PARKING METER

BACKGROUND OF THE INVENTION

1. Field of the Invention

The present invention relates generally to parking meters and more particularly to a coin collecting apparatus used in a system for collecting coins from a coin operated mechanism of a parking meter or a comparable coin actuated vending machine. The invention specifically relates to a coin collecting apparatus comprising both a coin container and a separate housing for collecting coins contained within the coin container.

2. The Prior Art

U.S. Pat. No. 2,815,166 to Sollenberger describes a typical coin handing apparatus which may be used in conjunction with the apparatus of the present invention. The prior art uses a coin box which is receivable within a recess defined by a receiver housing of a coin container. A closure carried by the box, and a sleeve of the receiver housing are adapted to be opened upon rotation of the box within the receiver housing. When the closure is opened, the contents of the box are discharged into the container, and the box is removed. The sleeve of the receiver housing prevents access to the interior of the coin container when the coin box is removed.

U.S. Pat. No. 4,729,509 to Diekhoff contemplates utilizing a similar coin box as that used by Sollenberger wherein the receiver housing of the container is provided with a cover so that the interior of the housing will not be exposed except when a coin box is being inserted or removed. The cover cooperates with the top of the coin box using an engaging means which is rotatable. When the cover is in a fully or partially opened condition, a locking bar and associated mechanism are provided for locking the receiver housing sleeve from rotation. When the sleeve is locked from rotation, the coin box cannot be rotated and the contents of the coin box are, therefore, maintained secure against unauthorized access. A problem with this system is that a collector could easily make a copy of the key which unlocks the mechanical lock to allow the sealed coin box to be rotated, and the coins are released into the collection cart.

SUMMARY OF THE INVENTION

The present invention comprises a unit sometimes referred to herein as a "smart box" contained within a locked collection cart or coin cart provided with a source of power to operate interlocking solenoids, access security codes, retrieve audit information, maintain time-of-day, and download/upload data to/from a central computer. A receptacle on a coin cart would be fitted with an unlocking solenoid which would be powered and actuated by the unit contained within the locked collection cart. The coin box used in the receptacle is equipped with an unlocking solenoid and an electronic circuit. The electronic circuit is capable of storing audit data when used in conjunction with an electronic meter. In addition, a security code may be maintained to relate to a security code contained in the unit for access control and for solenoid actuation. A male circuit connector in the coin cart receptacle replaces the conventional key, while a female circuit connector in the coin box replaces the conventional lock. A cart so equipped is referred to as a "smart cart."

The system operates in conjunction with an electronic meter mechanism capable of collecting audit data to be transmitted via a hard wire to a coin box memory chip. When the coin box is placed into the parking meter, it electronically interfaces with a mechanism via a similar plug/receptacle as that used in the collection cart. When the coin box is removed from the meter and placed in the collection receptacle of the collection cart, the cart checks for matching security access codes between the coin box and the unit. If the codes match, the unit will energize the solenoids in both the coin box and the coin cart receptacle, allowing the coin box to then be rotated and the coins to drop into the cart. With the use of an audit system, the unit would retrieve such audit information from the memory chip of the coin box at the time it is emptied into the cart. When the box is removed from the cart, the solenoids will de-energize and, therefore, secure both the collection receptacle and the coin box. This process can only be done when the box is returned to the closed position. Since a mechanical key is not being used in the present invention, additional protection against theft during collection is, therefore, provided.

DESCRIPTION OF THE PREFERRED EMBODIMENTS

Figure 1:
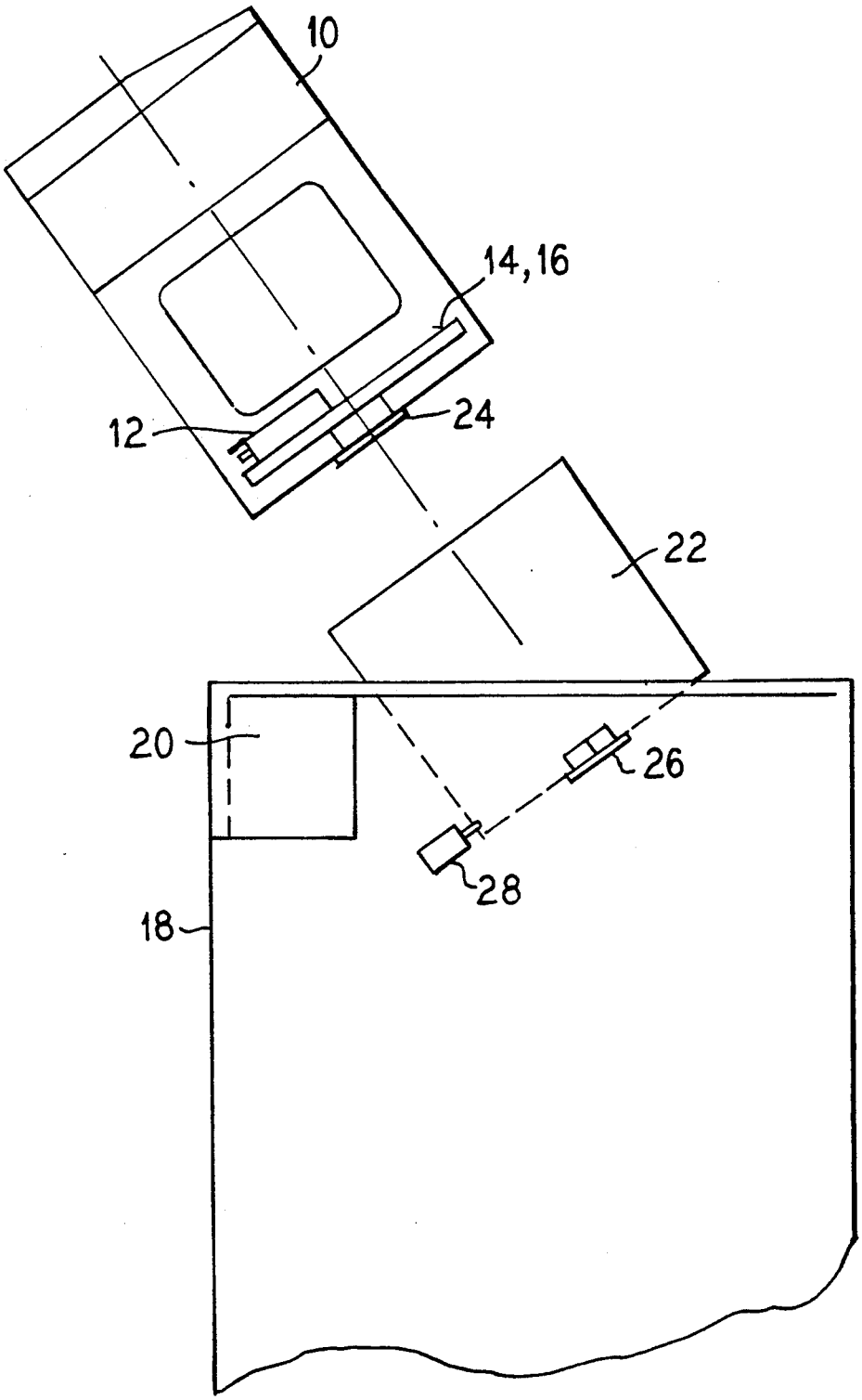
FIG. 1 is a vertical cross-sectional view of a coin box and of a receiver housing of the present invention.

Referring to the drawings in detail wherein like numerals are used to designate like parts, an electric coin box 10 is illustrated in FIG. 1 and incorporates a solenoid interlock 12 and an electronic circuit board 14 including a memory 16. The electronic coin box 10 is insertable into an electronic meter (not shown). The electronic circuit 14 in the coin box 10 is capable of storing audit data in memory 16 when it is used in conjunction with an electronic meter. The electronic circuit 14, in addition, maintains a security code to access control to the coin box 10 and to actuate the solenoid interlock 12.

A locked collection cart 18 contains an internal interface unit 20. In addition, the locked collection cart 18 contains an electronic collection head receptacle 22 which forms a sleeve for accepting the electronic coin box 10 when the coins in the electronic coin box 10 of the electronic meter are to be collected. The electronic coin box 10 has at its end a female interface plug 24 which engages with the male interface 26 at the end of the electronic collection head receptacle 22. The internal interface unit 20 contained inside the locked collection cart 18 provides power to operate the solenoid interlock 12 in the electronic coin box 10 as well as a solenoid interlock 28 contained within the locked collection cart 18 at the end of the electronic collection head receptacle 22.

In addition, the internal interface unit 20 allows for data access so that when the electronic coin box 10 is placed in the electronic collection head receptacle 22, a security code may be entered into the interface unit 20. If the security code entered into the interface unit 20 matches the security code stored in the memory 16 of the electronic coin box 10, the interface unit 20 provides power to the solenoid interlocks 12 and 28 in both the electronic coin box 10 and the electronic collection head receptacle 22 allowing the coin box 10 to be rotated and the coins to drop into the locked collection cart 18.

Another feature of the interface unit 20 is to retrieve audit information contained in the electronic circuit 14 when used in conjunction with an electronic meter. Any known data transfer device, i.e. memory card, data key, touch memory, etc. may be used to externally allow the locked collection cart 18 to retrieve audit data from the locked collection cart 18 as well as from each individual electronic coin box 10. The audit data may then be transferred to a central computer system via a meter manager interface port 50 shown in FIG. 4.

A conventional coin box, collection head receptacle and locked collection cart is shown in U.S. Pat. No. 2,815,166 to Sollenberger which is herein incorporated by reference.

Figure 2:
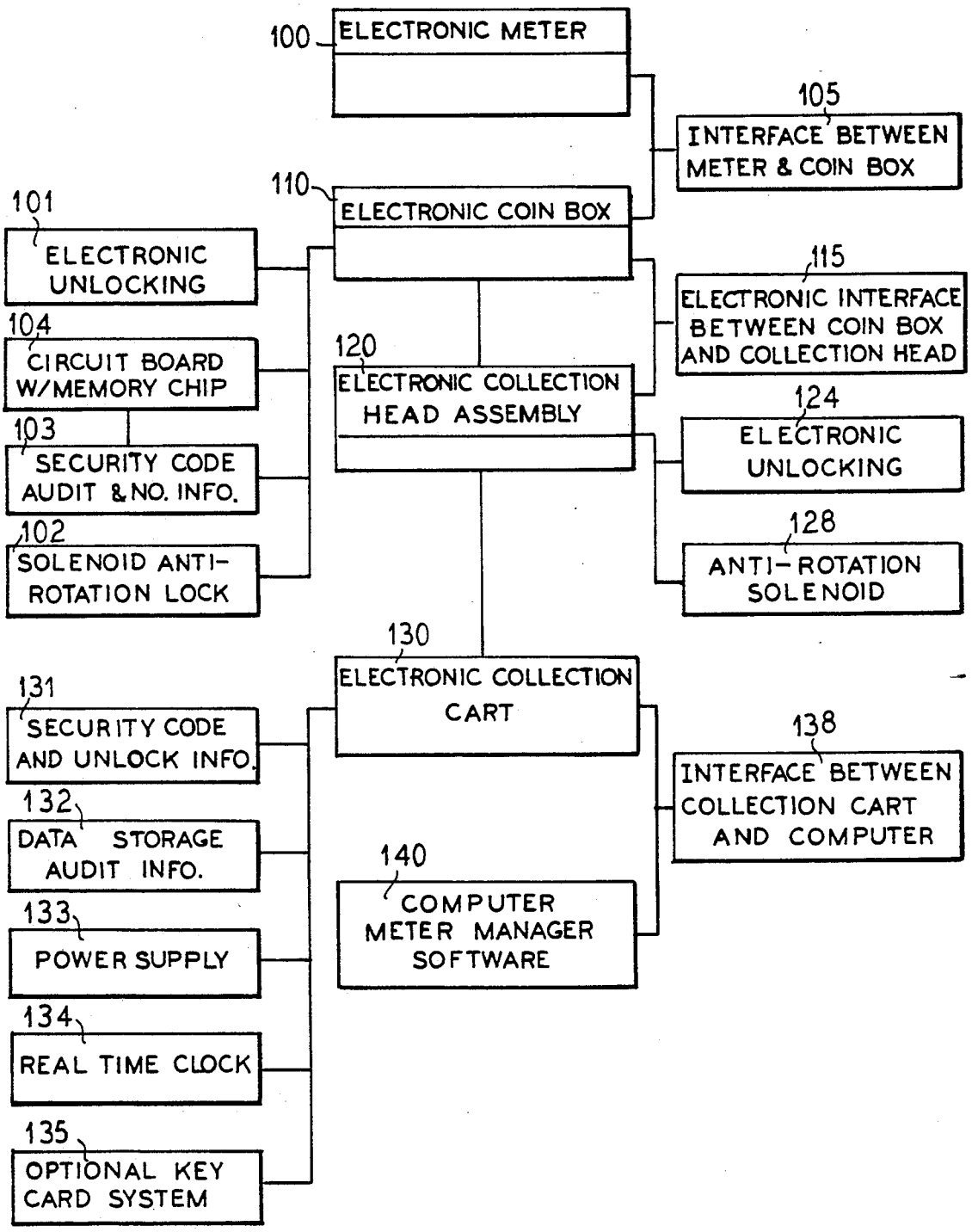
FIG. 2 is a flow chart detailing the operation of the present invention.

FIG. 2 illustrates the control and operation between the electronic meter 100, electronic coin box 110, electronic collection cart 130 and the computer meter manager software 140. The electronic meter 100 downloads audit information via an interface 105 between the meter 100 and the electronic coin box 110. The electronic coin box 110 may then effect electronic unlocking 101 or prevent solenoid actuation via a solenoid anti-rotation lock 102 based on a security code entered at 103 matching a security code entered at 131 on a unit at the electronic collection cart 130. The security code 103 is entered into a memory on a circuit chip 104 such that when a security code 131 is entered at the electronic collection cart 130, a comparison between the codes is made to determine whether to actuate unlocking of the solenoid interlock.

An electronic interface 115 is contained between the coin box 110 and the electronic collection head assembly 120 such that audit information and security information may be transferred. The electronic collection head assembly 120 is in communication with the solenoid interlock to provide electronic unlocking at 124 when the security code entered at the electronic collection cart 130 matches the security code stored in memory at 104 in the electronic coin box 110.

If the security codes do not match, the solenoid anti-rotation lock 102 and anti-rotation solenoid 128 are not activated. In addition to security code and unlock information stored in the electronic collection cart 130, it is also supplied with data stored audit information 132, a power supply 133 for activating the solenoid interlock, an a real time clock 134 to maintain time-of-day data. An optional key card system 135 may also be used to externally arm the cart 130 for collection from specified boxes as well as retrieve audit data from the full carts. The audit data may be transferred to a computer system 140 utilizing meter manager software via an interface 138 between the collection cart 130 and the computer system 140.

Figure 3:
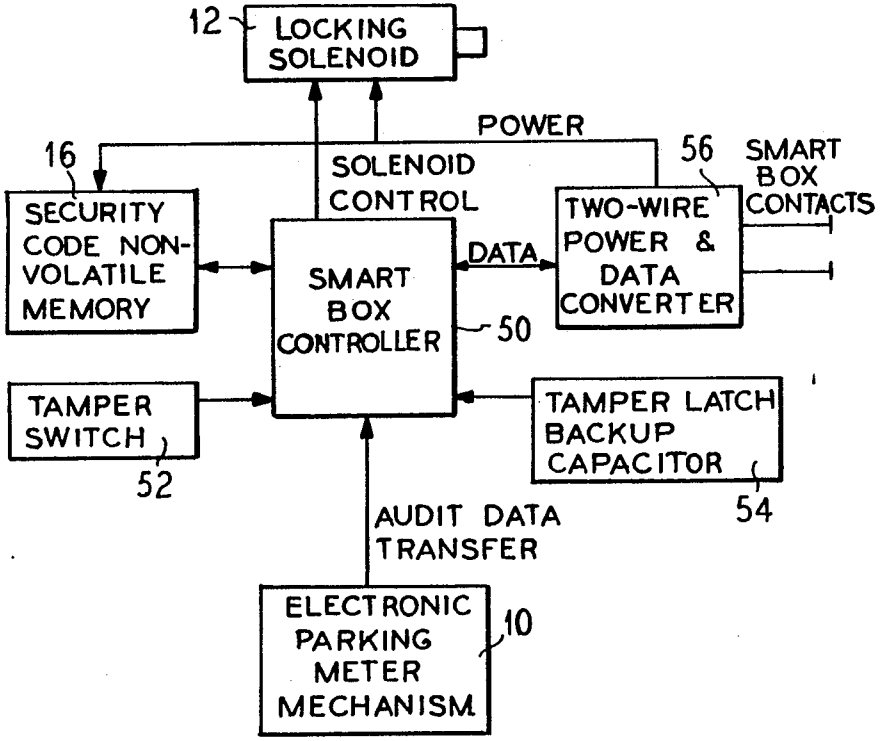
FIG. 3 is a diagram of a "smart box" as used in the present invention.

FIG. 3 is a schematic of the electronic circuitry required for operation of the electronic coin box 10 of the present invention. The electronic parking meter mechanism 10 transfers audit data to a smart box controller 50. The smart box controller 50 has a non-volatile memory 16 which stores a security code for access to the coin box within the electronic parking meter mechanism 10. Access is provided by the solenoid interlock 12 responding to the inputting of a valid security code by a collector.

A tamper switch 52 in cooperation with a tamper latch backup capacitor 54 is capable of recognizing unauthorized entry of the coin box 10 in the electronic parking meter mechanism and recording such entry in memory 16. Power is provided to the solenoid interlock 12 when the data converter and power source 56 determines that a security access code matches the security code in the non-volatile memory 16. The data converter 56 transfers audit data from the parking meter mechanism 10 via the controller 50, as well as receives data from the interface unit 20 shown in FIG. 1.

Figure 4:
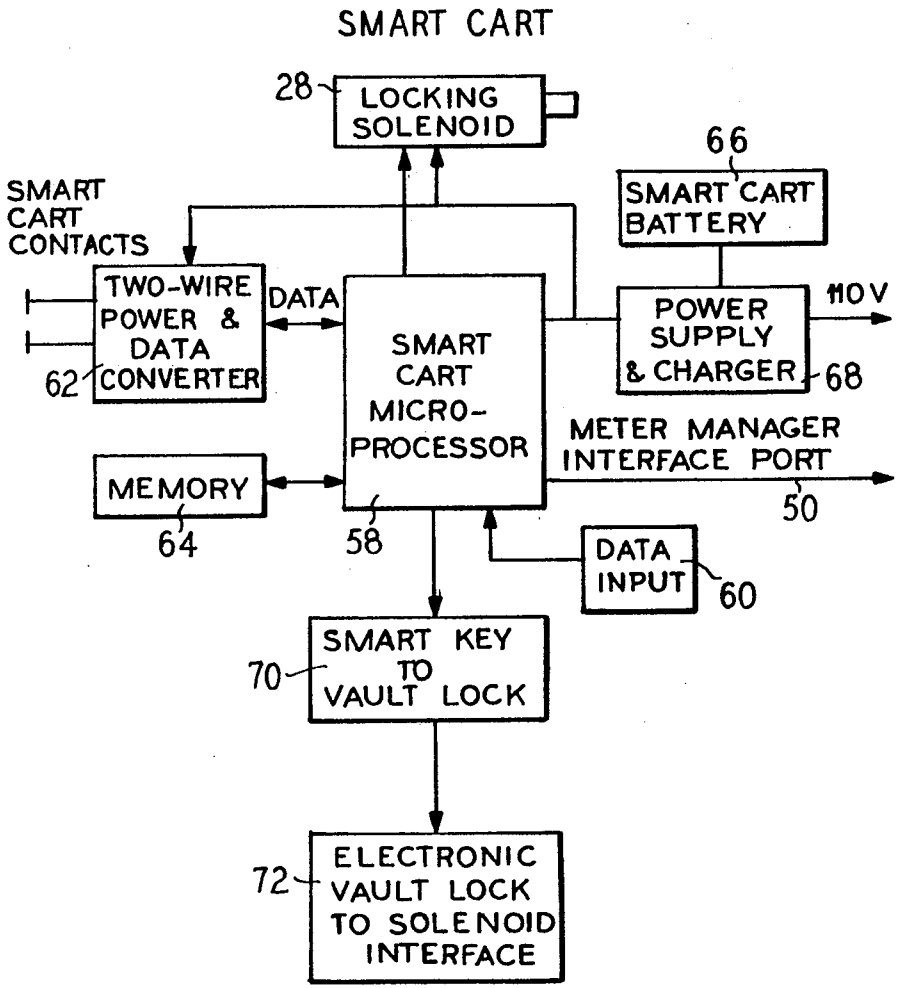
FIG. 4 is a diagram of a "smart cart" as used in the present invention.

FIG. 4 is a diagram of the electronic circuitry of the collection cart 18 and the internal interface unit 20 shown in FIG. 1. A microprocessor 58 equipped with a data input device 60 controls the operation of the cart 18. The data input device 60 may be any conventional input device, such as a keyboard. A security access code is input through the data input device 60 to the microprocessor 58. If the code matches the unique code of the electronic parking meter mechanism 10 in FIG. 3, then power is provided by the power source and data converter 62 to energize the interlocking solenoid 28 simultaneously with the solenoid interlock 12 shown in FIG. 3. Memory 64 in FIG. 4 stores audit information, time-of-day information and other desirable data to be sent to the central computer (not shown) via the meter manager interface port 50. A battery 66 is provided on the cart 18 to provide power to a power supply and charger 68 for operation of the system.

In addition, a key to a vault lock 70 is provided such that the lock at a vault is activated via a solenoid interface 72 to provide access to the cart 18 when the cart 18 is to be emptied at a central collection site.

When security codes between the coin box and the interface unit 20 match, the unit 20 will energize and unlock the solenoids 12, 28 in both the coin box 10 and the collection head receptacle 22. The coin box 10 may then be rotated and the coins will drop into the cart 18 as described in the Sollenberger patent. When the audit system is being used, the interface unit 20 retrieves audit information from the memory 16 of the coin box 10 at the time it is emptied into the cart 18. When the coin box 10 is removed from the cart 18 which can only be done when the box 10 is returned to its closed position, the solenoids 12, 28 will deenergize, therefore, securing both the collection head receptacle 22 and the coin box 10 from unauthorized entry.

This invention eliminates the problem associated with the prior art, that is the lack of security in conventional meter collection systems. In addition, the improved audit capabilities of this system improve the security since the contents of each coin collection box are more closely monitored.

Although various minor changes and modifications might be proposed by those skilled in the art, it will be understood that I wish to include within the claims of the patent warranted hereon all such changes and modifications as reasonably come within my contribution to the art.

I claim as my invention:

1. A coin collection apparatus comprising:

a coin box for collecting at a remote location;

second means for processing when said coin box for storing audit information in a first means for storing;

means for collecting coins from said coin box at a central location wherein said means for collecting is portable;

means for unlocking an opening of said means for collecting and said coin box when said means for collecting has been engaged with said coin box wherein said means for unlocking comprises a first solenoid means in said means for collecting and a second solenoid means in said coin box wherein said first and second solenoid means are actuated in response to said proper security code entered into said data input means; and first means for processing to provide power to said means for unlocking in response to a proper security code entered into a data input means operatively connected to said first means for processing wherein said first means for processing retrieves said audit information relating to said collected coins from said first means for storing within said second means for processing contained within said coin box.

2. The apparatus according to claim 1 wherein said first means for storing stores audit information and maintains a security code, and said second means for processing provides power for solenoid actuation.

3. The apparatus according to claim 1 wherein said proper security code is unique to said coin box.

4. The apparatus according to claim 1 wherein said first means for processing further comprises a second means for storing said retrieved audit information.

5. The apparatus according to claim 4 wherein said second means for storing is a touch memory.

6. The apparatus according to claim 1 further comprising means for downloading said audit information from said first means for processing to a central computer.

7. The apparatus according to claim 1 further comprising means for providing power to said means for collecting.

8. The apparatus according to claim 1 further comprising means for recognizing unauthorized entry wherein such entry may be recorded in said first means for storing.

9. The apparatus according to claim 1 further comprising:

a remote locked collection vault wherein said means for collecting may be emptied by activating a solenoid interlock at said remote vault.

10. A method for collecting coins comprising the steps of:

providing a portable means for collecting coins;

receiving a coin box in said means for collecting;

inputting a security code to a first processing means in said means for collecting;

activating a solenoid means in response to a proper security code being input to unlock said coin box and said means for collecting;

storing audit information relating to said collected coins in a first memory means of a second processing means within said coin box; and retrieving audit information from said first memory means by said first processing means to download said audit information to a central computer.

11. The method according to claim 10 further comprising the step of:

maintaining a unique security code for said coin box.

12. The method according to claim 10 further comprising the steps of:

recognizing unauthorized entry and recording such in said first memory means.

13. The method according to claim 10 further comprising the step of:

unlocking a remote vault in response to solenoid actuation of a locking means at said remote vault to thereby empty said means for collecting.

14. A parking meter comprising:

a housing;

mounting means for positioning the housing adjacent a designated parking space;

a coin box in said housing;

second means for processing within said coin box for storing audit information in a first means for storing;

portable coin collection means remote from said housing for receiving said coin box when said coin box has been removed from said housing for emptying its contents;

means for unlocking an opening of said means for collecting and said coin box when said means for collecting has been engaged with said coin box wherein said means for unlocking comprises a first solenoid means in said means for collecting and a second solenoid means in said coin box wherein said first and second solenoid means are actuated in response to said proper security code entered into said data input means; and first means for processing to provide power to said means for unlocking in response to a proper security code entered into a data input means operatively connected to said first means for processing wherein said first means for processing retrieves said audit information related to said contents of said coin box from said first means for storing within said second means for processing contained within said coin box.

15. The parking meter according to claim 14 wherein said first means for storing stores audit information and maintains a security code, and said second means for processing provides power for solenoid actuation.

16. The parking meter according to claim 14 wherein said proper security code is unique to said coin box.

17. The parking meter according to claim 14 wherein said first means for processing further comprises a second means for storing said retrieved audit information.

18. The parking meter according to claim 17 wherein said second means for storing is a touch memory.

19. The parking meter according to claim 14 further comprising means for downloading said audit information from said first means for processing to a central computer.

20. The parking meter according to claim 14 further comprising means for providing power to said coin collection means.

21. The parking meter according to claim 14 further comprising means for recognizing unauthorized entry wherein such entry may be recorded in said first means for storing.

22. The parking meter according to claim 14 further comprising:

a remote locked collection vault wherein said coin collection means may be emptied by activating a solenoid interlock at said remote vault.

* * * * *